US008365693B2

(12) United States Patent
Lancefield et al.

(10) Patent No.: US 8,365,693 B2
(45) Date of Patent: Feb. 5, 2013

(54) SINGLE CAM PHASER CAMSHAFT

(75) Inventors: Timothy Mark Lancefield, Shipston on Stour (GB); Nicholas James Lawrence, Buckingham (GB); Ian Methley, Witney (GB); Richard Alwyn Owen, Banbury (GB)

(73) Assignee: Mechadyne PLC, Kirtlington (GB)

( * ) Notice: Subject to any disclaimer, the term of this patent is extended or adjusted under 35 U.S.C. 154(b) by 310 days.

(21) Appl. No.: 12/863,747

(22) PCT Filed: Dec. 18, 2008

(86) PCT No.: PCT/GB2008/051204

§ 371 (c)(1),
(2), (4) Date: Jul. 20, 2010

(87) PCT Pub. No.: WO2009/092996

PCT Pub. Date: Jul. 30, 2009

(65) Prior Publication Data

US 2010/0282193 A1 Nov. 11, 2010

(30) Foreign Application Priority Data

Jan. 24, 2008 (GB) ..... 080124.1

(51) Int. Cl.
*F01L 1/04* (2006.01)

(52) U.S. Cl. ..... 123/90.6; 29/888.1

(58) Field of Classification Search ..... 123/90.6; 29/888.1; 74/567

See application file for complete search history.

(56) References Cited

U.S. PATENT DOCUMENTS

| | | | | |
|---|---|---|---|---|
| 3,251,626 | A * | 5/1966 | Martin | 297/188.21 |
| 5,582,143 | A * | 12/1996 | Stark et al. | 123/182.1 |
| 2004/0131443 | A1 | 7/2004 | Terry | |

FOREIGN PATENT DOCUMENTS

| | | |
|---|---|---|
| DE | 29922876 | 6/2000 |
| FR | 2426152 | 12/1979 |
| FR | 2695440 | 3/1994 |
| GB | 2375583 | 11/2002 |
| JP | 2000087946 | 3/2000 |
| WO | WO2006097767 | 9/2006 |

* cited by examiner

*Primary Examiner* — Zelalem Eshete
(74) *Attorney, Agent, or Firm* — Shalom Wertsberger; Saltamar Innovations

(57) ABSTRACT

A camshaft assembly is disclosed which comprises an inner shaft (12), an outer tube (14) surrounding and rotatable relative to the inner shaft (12), and two groups of cam lobes mounted on the outer tube, the first group of cam lobes being fast in rotation with the outer tube, and each cam (10) lobe (18) of the second group being rotatably mounted on the outer surface of the tube (14) and connected for rotation with the inner shaft (12) by means of one or more drive members (50) passing through circumferentially elongated slots in the outer tube. In the invention, each drive member comprises a (15) drive component (50*d*) engaged with fixed alignment in the cam lobe (18) and a separate fastener (50*b*) that is rotatable to clamp the drive component against a flat surface on the inner shaft (12), each drive member (50) being constructed such that during the tightening of the fastener (50*b*) no relative (20) sliding movement is required at the interface between the drive component (50*d*) and the inner shaft (12).

11 Claims, 4 Drawing Sheets

SINGLE CAM PHASER CAMSHAFT

FIELD OF THE INVENTION

The present invention relates to a camshaft assembly comprising an inner shaft, an outer tube surrounding and rotatable relative to the inner shaft, and two groups of cam lobes mounted on the outer tube, the first group of cam lobes being fast in rotation with the outer tube, the second group being rotatable relative to the outer tube and connected for rotation with the inner shaft by means of drive members passing through circumferentially elongated slots in the outer tube. Such an camshaft assembly is referred to herein as a single cam phaser (SCP) camshaft.

BACKGROUND OF THE INVENTION

The Applicants' earlier PCT patent application WO2006/097767, describes an SCP camshaft in which the positions of the drive members are adjustable in order to compensate for significant manufacturing inaccuracies between the inner shaft and its associated group of cam lobes. FIGS. 1A to 1E in the accompanying drawings correspond to FIGS. 2A to 2E respectively of the latter publication, which is incorporated herein by reference. In these drawings:

FIG. 1A is a side view of an SCP camshaft,

FIG. 1B is a section along the line I-I in FIG. 1A,

FIG. 1C is a section along the line II-II in FIG. 1A,

FIG. 1D is a partially exploded perspective view of the camshaft of Figure A, and FIG. 1E is a partially cut-away perspective view of the camshaft of FIG. 1A.

The SCP camshaft 10 is made up of an inner shaft 12 and an outer tube 14, the latter being supported in bearings 20. A first group of cams 16 is secured, for example by heat shrinking, for rotation with the outer tube 14 and a second group of cams 18 is secured for rotation with the inner shaft 12 by drive members 50 having the form of compound fastener each consisting of a nut 50*a* and a bolt 50*b*.

The shank of the bolt 50*b* passes with clearance through a hole in the drive shaft 12, and the head of the bolt and the nut act as drive members and are a tight clearance or an interference fit in the cam lobe 18.

In order to transmit torque between the cam lobe 18 and the inner drive shaft 12, the bolt and the nut are clamped against flat surfaces 12*a*, 12*b* on opposite sides of the drive shaft 12. The timing of each cam lobe 18 is therefore dictated by the position of the flat surfaces on the drive shaft 12 and the angle of the connecting pin bore in the cam lobe 18. The arrangement is shown clearly in FIGS. 1C and 1E.

An important aspect of this design is that once the two parts 50*a*, 50*b* of the fastener have been clamped on to the drive shaft 12, there must be no movement of the parts when the camshaft is in operation, as this will result in the camshaft becoming tight to turn. It is clearly an advantage therefore to maximise the coefficient of friction between the flat surfaces 12*a* and 12*b* of the drive shaft 12 and the parts of the fastener serving as a drive member, as this will increase the torque that can be applied to the cam lobe before any relative movement will take place.

SUMMARY OF THE INVENTION

According to the present invention, there is provided a camshaft assembly comprising an inner shaft, an outer tube surrounding and rotatable relative to the inner shaft, and two groups of cam lobes mounted on the outer tube, the first group of cam lobes being fast in rotation with the outer tube, and each cam lobe of the second group being rotatably mounted on the outer surface of the tube and connected for rotation with the inner shaft by means of one or more drive members passing through circumferentially elongated slots in the outer tube, wherein each drive member comprises a drive component engaged with fixed alignment in the cam lobe and a separate fastener that is rotatable to clamp the drive component against a flat surface on the inner shaft, each drive member being constructed such that during the tightening of the fastener no relative sliding movement is required at the interface between the drive component and the inner shaft.

It is known that high friction coatings using a layer of small, hard particles may be deposited onto the contact surfaces of mating parts to provide a positive 'key' due to the particles becoming embedded in the surfaces of both mating parts. It would be advantageous in the prior art design shown in FIG. 1 to use such a coating at the contact surfaces between the drive shaft faces and the fastener. However, in the latter design at least one of the drive members needs to be rotated relative to the inner drive shaft in order to clamp the cam lobe into position. If the rotating part were to have a high friction coating, it would only result in scoring of the interface with the drive shaft as the parts came into contact.

The present invention recognises that in order for high friction coatings to work effectively, the mating joint needs to be clamped without any relative sliding between the parts.

A further advantage of the invention is that it makes it easier to clamp the drive pin assembly onto the inner drive shaft in the correct position to eliminate manufacturing tolerances. In the known design shown in FIG. 1, the clamping face of the fastener tends to "walk" across the face of the drive shaft as it is tightened.

BRIEF DESCRIPTION OF THE DRAWINGS

The invention will now be described further, by way of example, with reference to the accompanying drawings, in which.

DETAILED DESCRIPTION OF THE PREFERRED EMBODIMENT(S)

In all the embodiments of the invention now to be described the drive members connecting the second group of cams for rotation with the inner shaft each comprise a first drive component that accurately engages the cam lobe and does not rotate during assembly of the camshaft, and a separate fastener that is rotated to clamp the first component against the inner shaft and is itself a clearance fit in the inner shaft and in the first component. By separating the drive component from the fastener in this way, the invention ensures that the drive component can be clamped against the inner shaft without any sliding movement taking place at the interface between them.

Figure 2A:
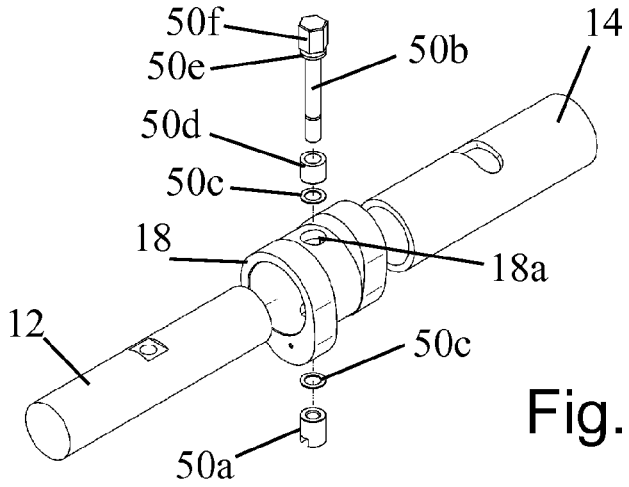
FIGS. 2A to 2D, show, respectively, an exploded perspective view, an assembled perspective view, an end view and a section in the plane marked in the end view, of a first embodiment of the invention, and FIGS. 3, 4 and 5 each show a different further embodiment of the invention, each of these figures being made up of the same four views as those of the embodiment of FIG. 2.
Figure 2B:
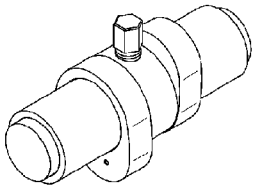
Figure 2C:
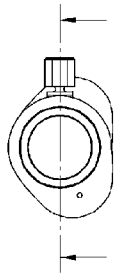
Figure 2D:
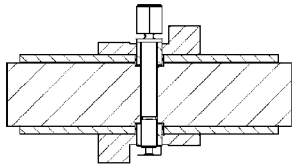

The first embodiment of the invention, shown in FIG. 2, includes a pair of high friction washers 50*c* that are coated in a high friction material on both of their mating faces.

Figure 1A:
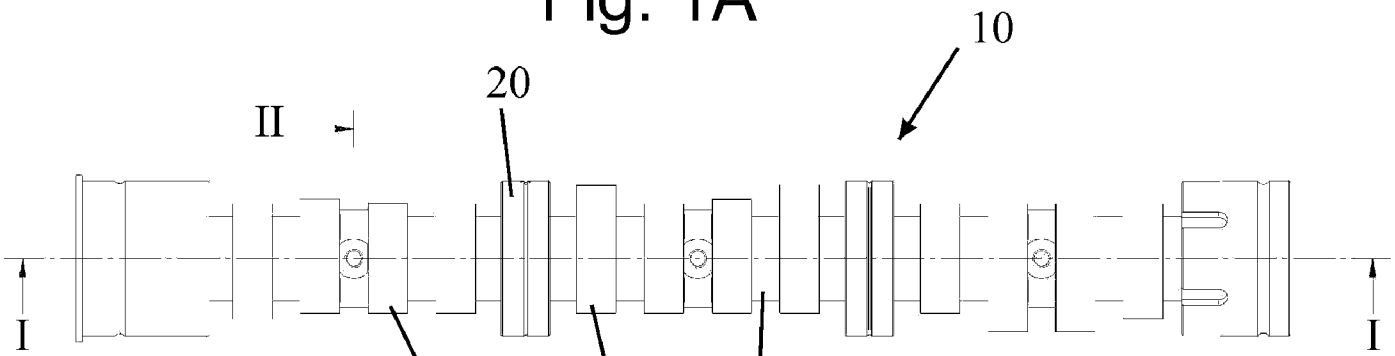
FIGS. 1A to 1E show a camshaft assembly as taught by WO2006/097767 and described above.
Figure 1B:
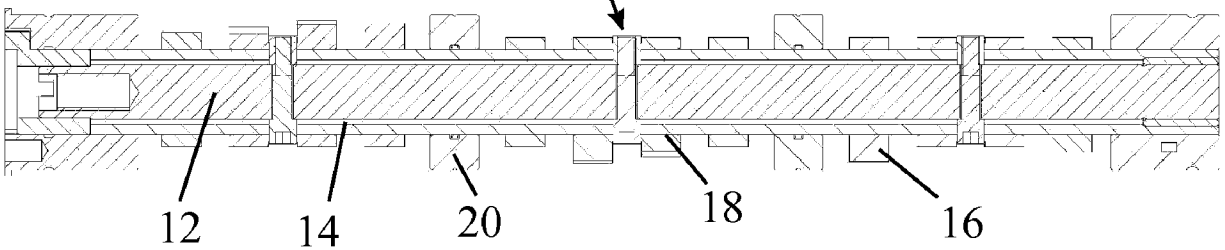
Figure 1C:
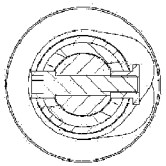
Figure 1D:
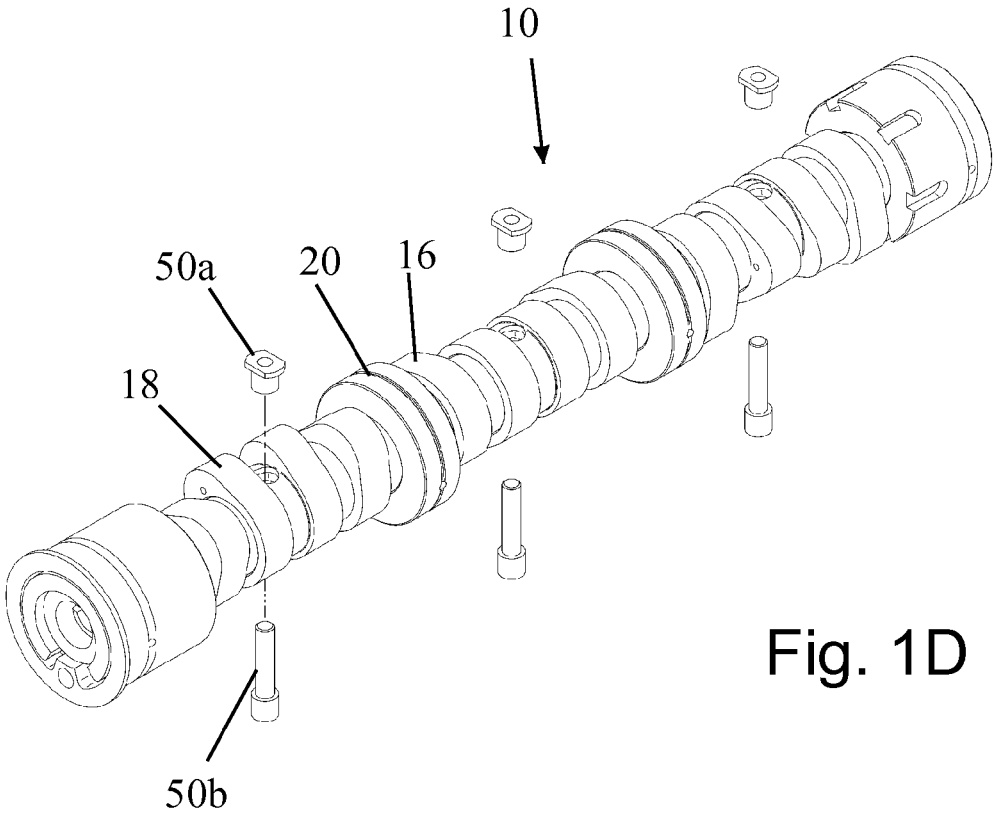
Figure 1E:
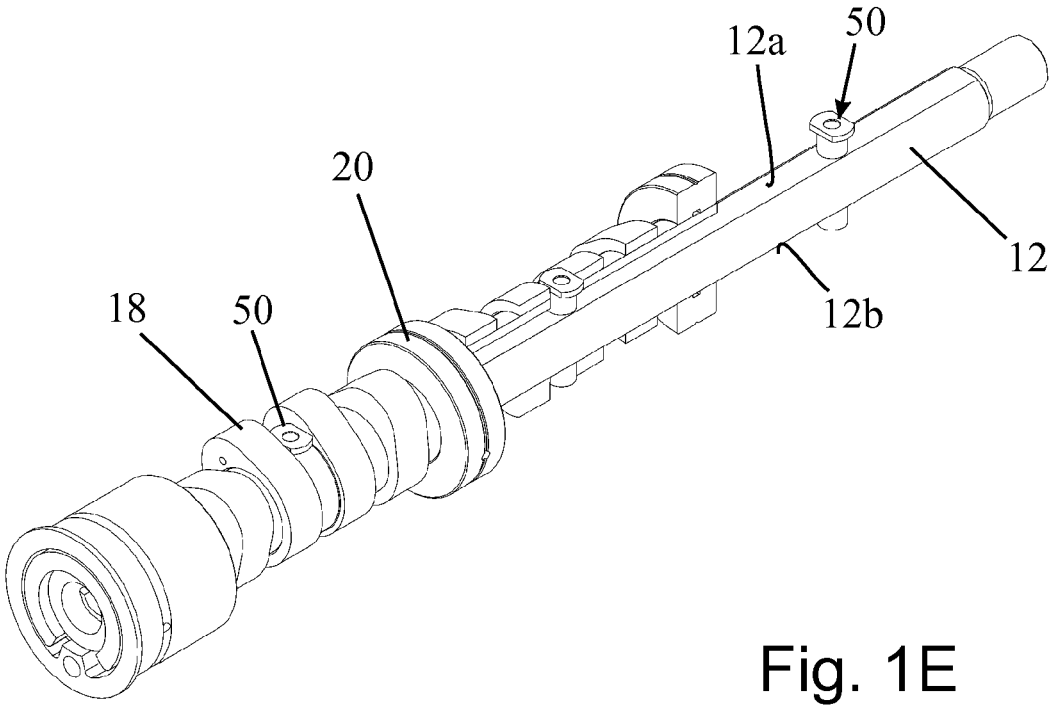

As with prior art design shown in FIG. 1, the clamping bolt 50*b*, which serves as the fastener, passes through a hole in the drive shaft 12 with clearance and engages with the thread in the clamping nut 50*a*. The clamping nut 50*a* serves as a drive component and is located in one end of a drive bore 18*a* of the cam lobe via a close clearance or interference fit. Instead of the head of the clamping bolt 50*b* locating in the opposite side of the drive bore 18*a*, there is a separate sleeve 50*d* that acts as a second drive component and that is clamped in position by a retaining flange 50*e* on the bolt 50*b*. The sleeve 50*d* is a clearance fit on the bolt 50*b* such that its position is only dictated by the drive bore 18*a* in the cam lobe 18.

This arrangement allows the clamping nut 50*a* to be held stationary whilst the bolt 50*b* is tightened and the drive sleeve 50*d* will also remain stationary due to its contact with the high friction washer 50*c* on its lower face. The bolt 50*b* is designed to have a reduced diameter adjacent to the head such that the head 50*f* will shear off when the correct tightening torque is reached. This approach allows the use of a fixing design that is not constrained to the space available to the camshaft when fitted to the engine—hence the head of the fixing is not required to lie within the envelope of the cam profile.

Although this embodiment uses high friction washers 50*c*, it would alternatively be possible to apply a high friction coating to the faces of the sleeve 50*d* and the clamping nut 50*a* that mate with the flats on the drive shaft (as shown at 12*a* and 12*b* in FIG. 1E), or to the flat faces of the drive shaft, in order to achieve a high friction coefficient between the compound connecting pin 50 and the drive shaft 12.

Figure 3A:
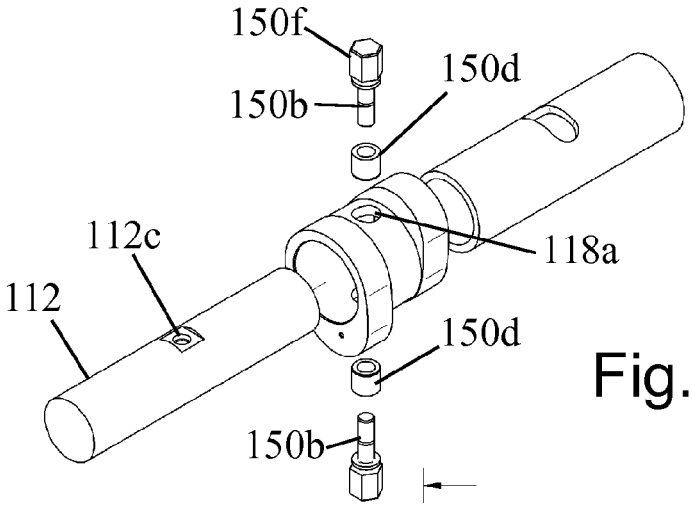
Figure 3B:
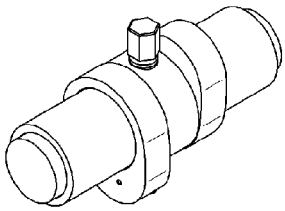
Figure 3C:
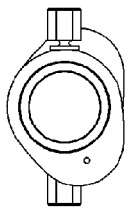
Figure 3D:
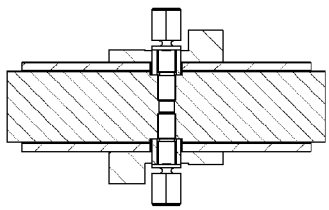

The second embodiment, shown in FIG. 3, uses two separate clamping bolts 150*b* as fasteners rather than a bolt and a nut. In this case, no high friction washers are present but a high friction coating is applied directly to the two drive sleeves 150*d*. The modified drive shaft 112 has a threaded bore 112*c* into which both clamping bolts 150*b* are secured, and the tolerance variations within the parts are compensated for by the clearance between the clamping bolts 150*b* and the bore of the drive sleeves 150*d*. This allows the position of the drive sleeves 150*d* to be dictated solely by the drive bore 118*a* of the camshaft lobe 118.

As with the previous embodiment, the drive sleeves 150*d* will not rotate relative to the inner drive shaft 112 during the tightening process because the high friction coating will hold them stationary at the interface with the drive shaft. Instead, slippage will occur under the retaining flanges of the clamping bolts 150*b*. Once again, the heads 150*f* of the clamping bolts 150*b* will shear off when the correct clamping torque has been reached.

Figure 4A:
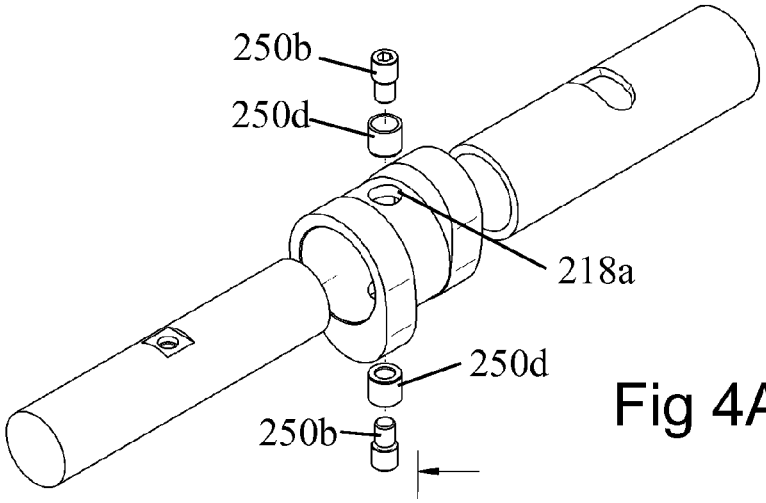
Figure 4B:
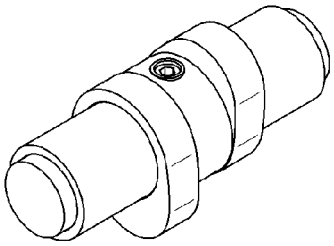
Figure 4C:
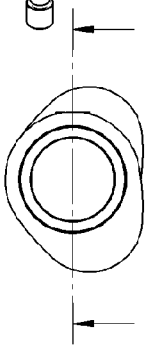
Figure 4D:
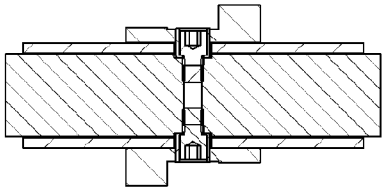

The third embodiment, shown in FIG. 4, is similar in principle to the second embodiment, save that the bolts 250*b* do not have heads that shear off when the correct clamping torque is reached. In this embodiment, the drive sleeves 250*d* have a clamping flange adjacent to the drive shaft 212, and the head of each clamping screw fits inside its drive sleeve as shown in FIG. 4D.

As with the previous embodiments, the bore of the drive sleeve 250*d* is a clearance fit on the bolts 250*b* so that its position is dictated by the drive bore 218*a* of the cam lobe 218. The face of the drive sleeve 250*d* may have a high friction coating applied, or a high friction washer may be added between the drive shaft and the drive sleeve.

Figure 5A:
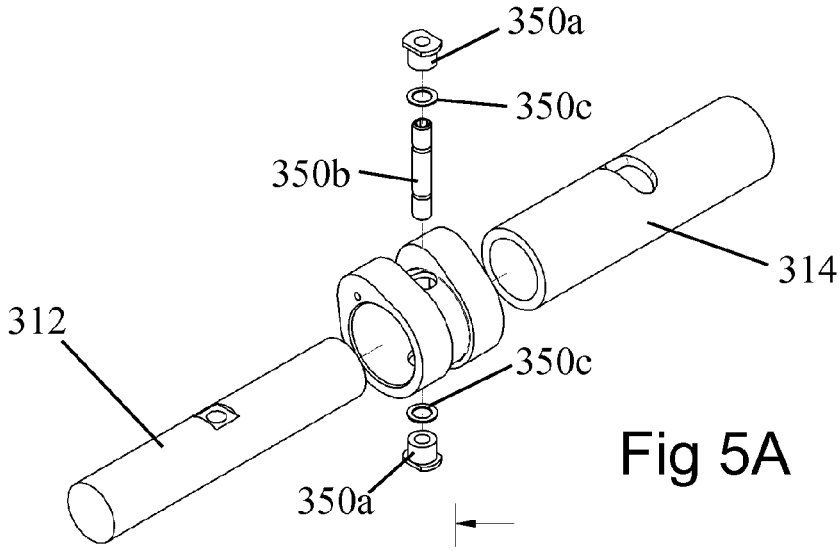
Figure 5B:
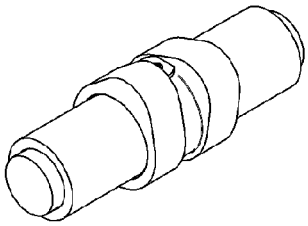
Figure 5C:
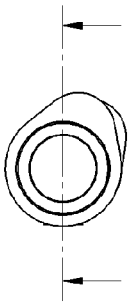
Figure 5D:
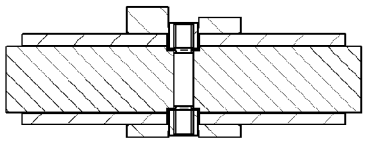

The fourth embodiment of the invention, shown in FIG. 5, uses a different clamping method to secure the drive pin assembly. In this embodiment, a double-ended clamping screw 350*b* is used as a fastener and has oppositely handed threads at its two ends. This allows the two clamping nuts 350*a*, which serve as the drive components, to be drawn together as the screw is rotated (for example by means of a screw driver or an Allen key) such that the drive shaft 312 is clamped between them without either of the nuts 350*a* rotating. The two clamping nuts 350*a* are both provided with anti-rotation features and are seated on high friction washers 350*c* to prevent them from sliding relative to the drive shaft.

The invention claimed is:

1. A camshaft assembly comprising:

an inner shaft;

an outer tube surrounding and rotatable relative to the inner shaft;

two groups of cam lobes mounted on the outer tube, the first group of cam lobes being fast in rotation with the outer tube, and each cam lobe of the second group being rotatably mounted on the outer surface of the tube and connected for rotation with the inner shaft by at least one drive member passing through circumferentially elongated slots in the outer tube;

wherein each drive member comprises two drive components engaged with fixed alignment in the cam lobe, and at least one threaded fastener, separate from the two drive components, that is rotatable relative to at least one drive component to clamp the two drive components against respective flat surfaces on the inner shaft, whereby, during tightening of each fastener, neither drive component rotates relative to the respective flat surface on the inner shaft.

2. A camshaft assembly as claimed in claim 1, wherein the drive components are part cylindrical and are received into corresponding bores in the cam lobe with a close clearance or interference fit.

3. A camshaft assembly as claimed in claim 2, wherein the threaded fastener clamping the first drive component to the inner shaft is a bolt passing with clearance through the two drive components and threaded into a nut disposed on the opposite side of the second drive component.

4. A camshaft assembly as claimed in claim 2, wherein the threaded fastener is a bolt passing with clearance through one of the two drive components and threaded into the other drive component.

5. A camshaft assembly as claimed in claim 2, wherein each drive component is secured to the inner shaft by a respective fastener bolt that is screwed into the inner shaft.

6. A camshaft assembly as claimed in claim 2, wherein the fastener is a shaft having oppositely handed threads at its opposite ends which passes with clearance through the inner shaft and is engaged in internal threads in the two drive components.

7. A camshaft as claimed in claim 1, wherein the threaded fastener is manufactured with a head that will shear off once a predetermined clamping torque has been applied to the fastener.

8. A camshaft as claimed in claim 1, wherein the head of the or each threaded fastener is received within a drive component.

9. A camshaft as claimed in claim 1, wherein each drive component is provided with a feature to prevent the drive component from rotating relative to the shaft or to the associated cam lobe when clamped into position.

10. A camshaft assembly as claimed in claim 1, in which a high friction coating is applied to each drive component or to each flat surface of the inner shaft.

11. A camshaft assembly as claimed in claim 1, wherein a high friction washer is interposed between each drive component and the mating flat surface of the inner shaft.

* * * * *